United States Patent [19]

Kaufer

[11] Patent Number: 4,468,816

[45] Date of Patent: Sep. 4, 1984

[54] NURSING GARMENT

[76] Inventor: Selma Kaufer, 14005 Palawan Way, Apt. 311, Marina del Rey, Calif. 90291

[21] Appl. No.: 473,336

[22] Filed: Mar. 8, 1983

[51] Int. Cl.[3] ..... A41D 1/20

[52] U.S. Cl. ..... 2/104

[58] Field of Search ..... 2/104, 88, 69, 49 R

[56] References Cited

U.S. PATENT DOCUMENTS

| | | | |
|---|---|---|---|
| 2,722,685 | 11/1955 | Lucas | 2/49 |
| 4,106,122 | 8/1978 | Dodd | 2/104 |
| 4,208,743 | 6/1980 | Whitcraft | 2/104 |
| 4,280,228 | 7/1981 | Sulzmann | 2/104 |

FOREIGN PATENT DOCUMENTS

| | | | |
|---|---|---|---|
| 197804 | 4/1978 | Fed. Rep. of Germany | 2/88 |
| 1015568 | 1/1966 | United Kingdom | 2/88 |

*Primary Examiner*—Doris L. Troutman

*Attorney, Agent, or Firm*—Kendrick, Netter & Bennett

[57] ABSTRACT

A reversible nursing mother's garment includes a single shoulder loop attached to and carrying a drape for the wearer's breast nearer the loop. The drape includes front and rear panels. The front panel extends downwardly from the single shoulder loop towards the wearer's waistline and laterally from the wearer's side across the wearer's breast that is near the shoulder loop.

5 Claims, 4 Drawing Figures

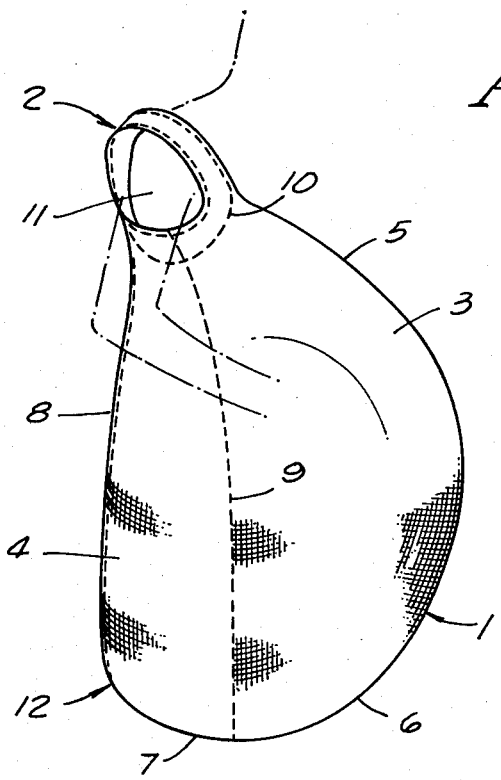
FIG. 1.
FIG. 2.
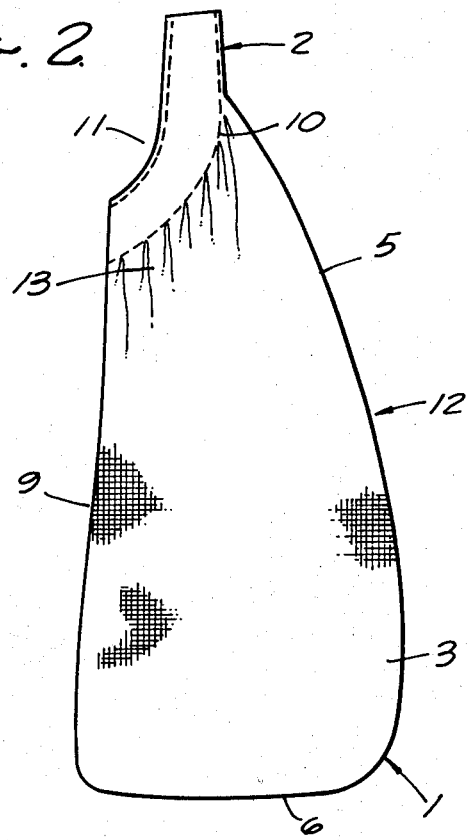
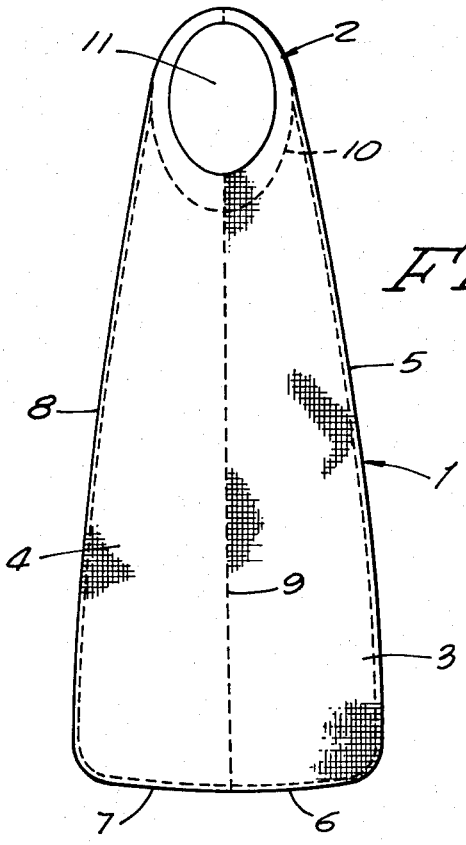
FIG. 3.
FIG. 4.
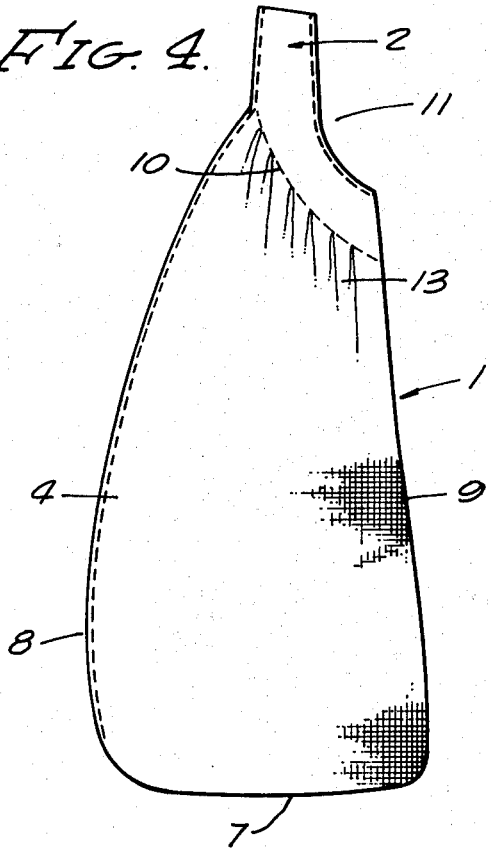

NURSING GARMENT

This invention relates to a garment for use by nursing mothers who wish to nurse their infants modestly and conveniently in public.

The nursing mother's garment of this invention is reversible, and includes a single shoulder loop attached to and carrying means for draping the wearer's breast nearer the loop. The draping means includes a front panel and a rear panel, preferably joined to one another along the wearer's side. The front panel extends laterally from the wearer's side across the wearer's chest a distance at least sufficient to cover the wearer's breast nearer to the single shoulder loop. The front panel also extends downwardly from the shoulder loop a distance sufficient to cover the wearer's breast, and at least the head, neck and shoulders of an infant nursing at the wearer's breast nearer to the shoulder loop. Preferably, the front panel of the drape is linked to the single shoulder loop through a plurality of pleats. Preferably, too, the edge of the front panel extends downwardly and obliquely from the single shoulder loop across the wearer's chest toward a bottom edge near the wearer's waistline, and with the bottom edge extending beyond the centerline of the wearer's chest.

The back panel of the nursing garment also preferably extends downwardly from the shoulder loop toward a bottom edge near the wearer's waistline, and laterally from the wearer's side toward, but not to, the wearer's spine.

The invention can better be understood by reference to the drawings accompanying this specification, in which:

FIG. 1 is a side elevation view in perspective of the reversible nursing garment of this invention;

FIG. 2 is a front elevation view of the nursing garment illustrated in FIG. 1;

FIG. 3 is a side elevation view of the nursing garment shown in FIGS. 1 and 2; and FIG. 4 is a back elevation view of the nursing garment shown in FIGS. 1–3.

As the drawings illustrate, the preferred embodiment of the new, reversible nursing garment, generally designated 1, includes a single shoulder loop, generally designated 2, and means for draping the wearer's breast nearer the single shoulder loop 2, generally designated 12. Single shoulder loop 2 includes armhole 11 through which the wearer passes her arm to seat shoulder loop 2 on her shoulder. Because the garment is reversible, the garment can be worn on either the left shoulder or the right, and can readily be shifted from one shoulder to the other.

Joined to the single shoulder loop 2, along line 10, is the means 12 for draping the wearer's breast nearer to the single shoulder loop 2. Draping means 12 includes front panel 3, and rear panel 4, joined to one another alone line 9; line 9 lies at the wearer's side when the garment is in use. Front panel 3 extends downwardly from single shoulder loop 2 to lower edge 6 which falls near the waistline of the wearer. Front panel 3 extends laterally from side line 9 a distance at least sufficient to cover the wearer's breast near single shoulder loop 2, here edge 5. Edge 5 extends downwardly from single shoulder loop 2 at an oblique angle toward the centerline of the wearer's chest and must extend outwardly and downwardly sufficiently far to cover the head, neck and preferably the shoulders of an infant nursing at the wearer's breast beneath garment 1.

Rear panel 4 can be and preferably is a mirror image of front panel 3. Thus, panel 4 extends downwardly from single shoulder loop 2 to lower edge 7 near the wearer's waistline, and laterally from side line 9 to panel edge 8. However, panel edge 8 need not extend outwardly and downwardly at an oblique angle from shoulder loop 2, but may extend more nearly vertically downward from single shoulder loop 2 than does front panel 3.

Along line 10, where single shoulder loop 2 joins draping means 12, are a plurality of pleats, generally designated 13. Pleats 13 facilitate extending the front panel of the garment farther across the wearer's chest, thus accommodating wearers and infants of many sizes.

Because the new nursing garment is worn over the wearer's outer clothes, is reversible, and is relatively compact, the garment is particularly useful for nursing mothers who wish to nurse their infants in public discreetly and conveniently.

What is claimed is:

1. A reversible, nursing mother's garment comprising a single shoulder loop that fits only over a mother's arm and shoulder on one side of her body, and, attached to said shoulder loop, means for draping the wearer's breast nearer to said single shoulder loop, said draping means including a front panel and a rear panel, said front panel extending laterally from the wearer's side across the wearer's chest a distance at least sufficient to cover the wearer's breast nearer to said single shoulder loop, and extending downwardly, outwardly and obliquely across the wearer's chest from said single shoulder loop a distance sufficient to cover at least the head, neck and shoulders of an infant nursing at said nearer breast.

2. The nursing garment of claim 1 wherein said front panel extends to a bottom edge near the wearer's waistline.

3. The nursing garment of claim 1 wherein said back panel extends downwardly from said single shoulder loop toward a bottom edge near the wearer's waistline, and extends laterally from the wearer's side toward the wearer's spine.

4. The nursing garment of claim 1 wherein said draping means is linked to said single shoulder loop through a plurality of pleats.

5. A reversible, nursing mother's garment comprising a single shoulder loop that fits only over a mother's arm and shoulder on one side of her body, and, attached to said shoulder loop, for draping the wearer's breast nearer to said single shoulder loop, said draping means including a front panel and a rear panel, said front panel having an edge which extends downwardly, outwardly and obliquely from said single shoulder loop across the wearer's chest toward a bottom edge near the wearer's waistline.

* * * * *

UNITED STATES PATENT AND TRADEMARK OFFICE

CERTIFICATE OF CORRECTION

PATENT NO. : 4,468,816

DATED : September 4, 1984

INVENTOR(S) : Selma Kaufer

It is certified that error appears in the above-identified patent and that said Letters Patent is hereby corrected as shown below:

Column 2, line 56, before "for", insert --means--.

Signed and Sealed this

*Fourteenth* Day of *May 1985*

[SEAL]

*Attest:*

DONALD J. QUIGG

*Attesting Officer* *Acting Commissioner of Patents and Trademarks*